United States Patent [19]

Kida

[11] Patent Number: 4,474,201

[45] Date of Patent: Oct. 2, 1984

[54] UMBRELLA WITH OVAL CANOPY

[76] Inventor: Nobutoshi Kida, 398-57, Higashi-ikoma 3-chome, Ikoma, Nara 630-02, Japan

[21] Appl. No.: 410,002

[22] Filed: Aug. 20, 1982

[30] Foreign Application Priority Data

Mar. 19, 1982 [JP] Japan ..... 57-44899

[51] Int. Cl.[3] ..... A45B 11/00

[52] U.S. Cl. ..... 135/20 R

[58] Field of Search ..... 135/20 R, 20 A, 25, 135/26, 31

[56] References Cited

U.S. PATENT DOCUMENTS 1,168,427 1/1916 Saraniecki ..... 135/26
1,299,877 4/1919 Verdugo ..... 135/26

FOREIGN PATENT DOCUMENTS 912897 5/1946 France ..... 135/20 A
4565 12/1937 Japan .
56759 12/1974 Japan .
19952 12/1976 Japan .
8927 12/1979 Japan .

*Primary Examiner*—Harland S. Skogquist
*Attorney, Agent, or Firm*—Trexler, Bushnell & Wolters, Ltd.

[57] ABSTRACT

An umbrella with an oval or substantially oval canopy comprising a center pole (1), a plurality of short conventional main ribs (3), and a plurality of long main ribs (18). Each long main rib (18) consists of a proximal main rib (20), a distal main rib (22) slidably fitted to the proximal main rib (20) through a slide member (30), and upper and lower stops (31)(32) fixed thereon. When opened, the canopy automatically assumes an oval form or substantially oval form, and when closed, the distal ends of the main ribs automatically lie on the same plane.

14 Claims, 10 Drawing Figures

Fig. 1(c)
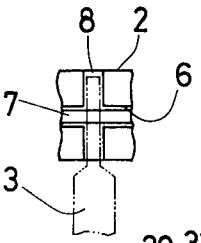
Fig. 1(d)
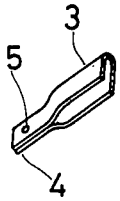
Fig. 1
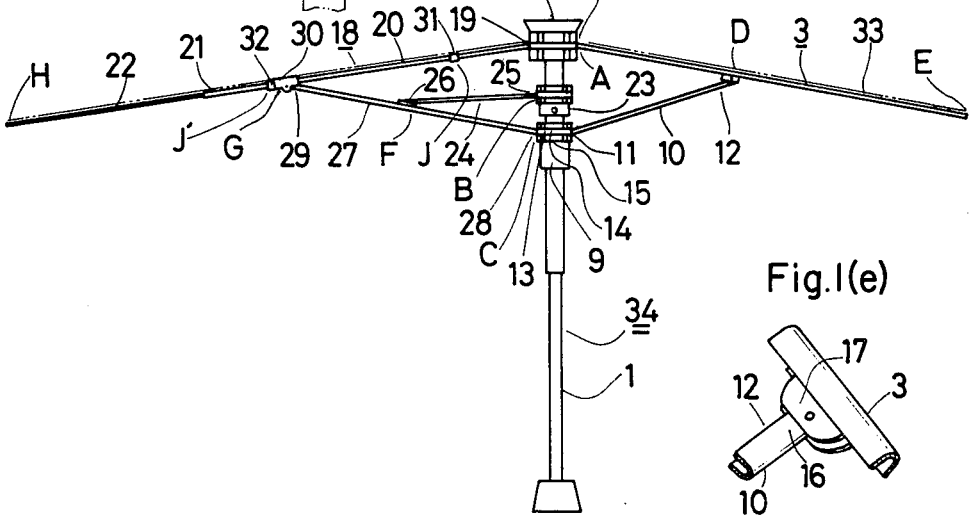
Fig. 1(e)
Fig. 1 (a)
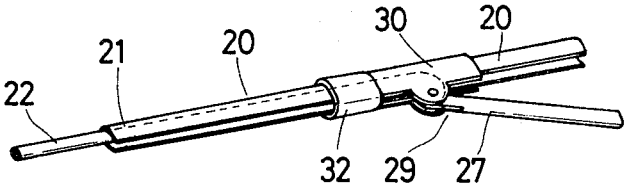
Fig. 1 (b)
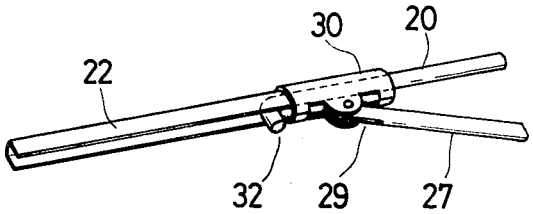

UMBRELLA WITH OVAL CANOPY

The present invention relates to an umbrella whose canopy is substantially oval when the umbrella is opened.

Most conventional umbrellas are so designed that the canopy is round when the umbrella is opened and that the center pole is located at the center of the circle, so that the canopy deviates to the right or left or to the front or back depending upon the position of the hand of a person holding the umbrella, thus incurring the possibility that the right or left side or the front or back side of the person putting up the umbrella, or the baggage he is carrying will become wet.

To avoid this situation, there have been proposed various umbrellas so designed that the canopy is substantially oval when the umbrella is opened. For example, Japanese Utility Model Publication No. 4565/1937 (hereinafter referred to as the reference 1) discloses an umbrella comprising main ribs which are made different in length so that when the umbrella is opened the canopy spreads out to one side to assume a substantially oval shape, short stay ribs pivotally connected to the short main ribs, long stay ribs pivotally connected to the long main ribs, a plurality of hub tubes each having the distal ends of the stay ribs of the same length pivotally connected thereto, the hub tube for the short stay ribs being disposed at the top with the hub tubes for successibely longer stay ribs being disposed at successively lower levels, said hub tubes being slidably fitted on the center pole. The presence of the many hub tubes complicates the production and adds to the weight. Further, when the umbrella is closed, the main ribs gathered around the center pole differ in length, which is very unsightly, and the umbrella in its closed state is considerably long, causing inconvenience in handling.

An umbrella disclosed in Japanese Utility Model Application Disclosure No. 19952/1976 consists in equalizing the lengths of the stay ribs in the reference 1, using a single hub tube, and making the distal end portions of the long main ribs outwardly foldable. Although this umbrella is simpler in construction than the one shown in the reference 1, opening or closing the umbrella requires the manual operation of unbending or bending the long main ribs one by one, which is very troublesome in use. Another disadvantage is that since the distal end portions will be subjected to an inwardly folding force due to rain, they cannot be made very long.

An umbrella disclosed in Japanese Utility Model Publication No. 8927/1979 consists in replacing the plurality of hub tubes in the reference 1 by a single long hub tube having vertical slots cut in the periphery thereof allowing the pivotal points of the stay ribs to move. As in the reference 1, with this umbrella in its closed state, the main ribs gathered around the center pole differ in length, injuring the appearance, and the umbrella in its closed state is considerably long, causing inconvenience in handling. Further, the hub construction is complicated and the production cost is high.

Accordingly, it is an object of this invention to provide a novel and improved umbrella with an oval canopy.

A more specific object of this invention is to provide an umbrella with an oval canopy so designed that when the umbrella is opened, the canopy automatically assumes an oval form or substantially oval shape spreading out to one side from a circle or assumes a star shape.

A related object of this invention is to provide an umbrella with an oval canopy so designed that when the umbrella is closed, the distal ends of the main ribs automatically lie on the same plane, presenting an external appearance not differing from that of a conventional umbrella.

An umbrella with an oval canopy in accordance with this invention comprises:

(A) a center pole having an upper hub fixed thereto, and intermediate and lower hubs slidably mounted thereon;

(B) a plurality of short main ribs which are pivotally connected at their proximal ends to said upper hub and to which are connected at their middle regions the distal ends of support ribs whose proximal ends are pivotally connected to said lower hub;

(C) and a plurality of long main ribs each consisting of:

(a) a proximal main rib pivotally connected at its proximal end to said upper hub;

(b) a distal main rib slidably fitted to the distal end of said proximal main rib through a slide member, said slide member having pivotally connected thereto the distal end of a long support rib to which is pivotally connected at its middle region the distal end of a stay rib pivotally connected at its proximal end to said intermediate hub and whose proximal end is pivotally connected to said lower hub;

(c) and upper and lower stops fixed on said long main rib.

Other objects, features and advantages of the invention will become more readily apparent upon reading the following detailed description of the illustrated embodiments together with reference to the accompanying drawings wherein:

FIG. 1 is an elevation of the principal portion of an umbrella of the first embodiment of the invention when opened, FIG. 1 (*a*) being an enlarged view of the slide member and preventive member and FIG. 1 (*b*) being the same view as FIG. 1 (*a*) of a varied form.

FIGS. 1(*c*), 1(*d*) and 1(*e*) are enlarged views of portions of FIG. 1.

Figure 2:
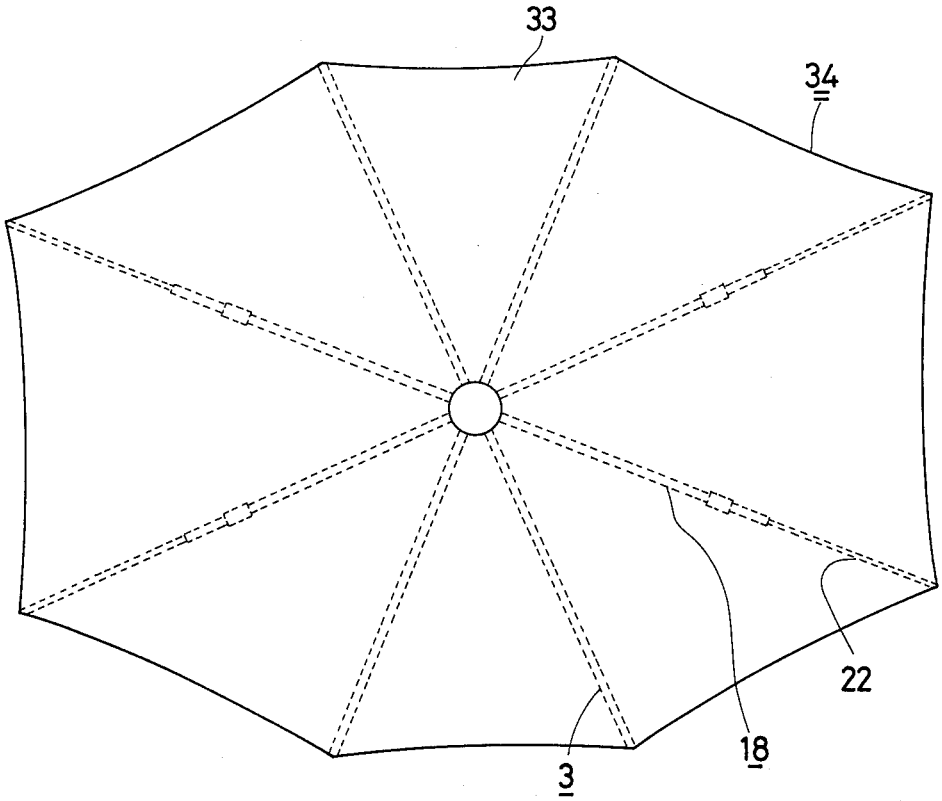
FIG. 2 is a plan view of the umbrella of the first embodiment when opened.

A first embodiment of the invention shown in FIGS. 1–3 will now be described referring mostly to FIG. 1.

The numeral 1 denotes a center pole; 2 denotes an upper hub fixed on the tip of the center pole 1; and 3 denotes short main ribs pivotally connected at their proximal ends 4 to the upper hub 2. The short main ribs 3 are held in position, as best viewed in FIG. 1(*c*), in that a wire 7 fitted in a groove 6 formed around the periphery of the upper hub 2 is passed through holes 5, as best seen in FIG. 1(*d*), each formed in the flat portion of the proximal end 4, so that the short main ribs are turnable around the wire 7 within vertical slots 8 crossing the groove 6.

The numberal 9 denotes a lower hub slidably fitted on the center pole 1, and 10 denotes support ribs pivotally connected at their proximal ends 11 to the lower hub 9 and at their distal ends 12 to the middle regions of the short main ribs 3. The support ribs 10 are held in the lower hub 9 in that a wire 14 fitted in a groove 13 formed around the periphery of the lower hub 9 is passed through holes each formed in the flat portion of the proximal end 11, so that the support ribs are turnable around the wire 14 within vertical slots 15 crossing the groove 13, said support ribs being pivotally connected at the flat portions 16 of their distal ends 12 to the short main ribs 3 through fixtures 17 secured to the latter.

The numeral 18 denotes long main ribs each consisting of a proximal main rib 20 of required length pivotally connected at its proximal end 19 to the upper hub 2 in the same manner as in the short main ribs 3, and a distal main rib 22 of required length slidably fitted to said proximal main rib 20. The distal main rib 22 may be slidably inserted to the proximal main rib 20 as shown in FIG. 1 (*a*); or as shown in FIG. 1 (*b*), the distal main rib 22 may be slidably inserted in the U-grooved proximal main rib 20.

The numeral 23 denotes an intermediate hub fixed on the center pole 1 under the upper hub 2, and 24 denotes stay ribs pivotally connected at their proximal ends to the intermediate hub 23 in the same manner as the long and short main ribs 18 and 3 are pivotally connected at their proximal ends 19 and 4 to the upper hub 2, the distal ends 26 of said stay ribs being pivotally connected to the middle regions of long support ribs 27. The construction for attaching the distal ends 26 of the stay ribs 24 to the long support ribs 27 is the same as that for attaching the support ribs 10 to the short main ribs 3.

The long support ribs 27 are pivotally connected at their proximal ends 28 to the lower hub 9 by the same method as that for attaching the proximal ends 11 of the support ribs 10, the distal ends 29 of said long support ribs being pivotally connected to the proximal ends 30 of the distal main ribs 22 fitted in the proximal main ribs 20. The numeral 30 denotes a slide member to which the distal end 29 of the stay rib 27 and the proximal end of the distal main rib 22 are connected. The numerals 31 and 32 denote upper and lower stops fixed on the proximal main rib 20 at upper and lower positions respectively for controlling the slide movement of the slide member 30. As shown in FIG. 1 (*a*), the lower stop 32 may take the form of a ring; or as shown in FIG. 1 (*b*), the lower stop 32 may take the form of a projection formed by bending the distal end of the proximal main rib 20.

A plurality of short main ribs 3 and long main ribs 18 arranged in the manner described above (4 each in FIG. 2) are respectively symmetrically arranged around the center pole 1 to form umbrella ribs, and an umbrella cloth 33 is spread and secured at the upper hub 2 and at the distal ends of the short and long main ribs 3 and 18 to form the canopy, thus providing an umbrella 34.

Figure 3:
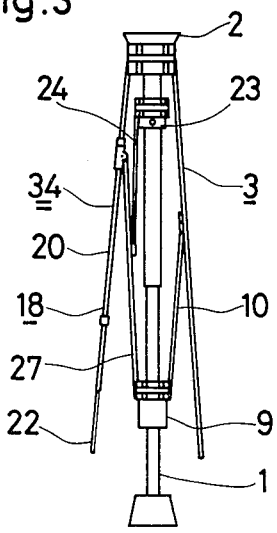
FIG. 3 is an elevation of the umbrella of the first embodiment when closed.

As shown in FIG. 2, when this umbrella 34 is opened, the canopy spreads out to opposite sides of the conventional circle to assume an oval shape.

When the lower hub 9 is upwardly slid, the short main ribs 3 are outwardly opened as in a conventional umbrella. As for the long main ribs 18, since the stay ribs 24 and the long support ribs 27 are pivotally connected together at point F and since the proximal ends 25 of the stay ribs 24 are fixed at point B, with the upward movement of the lower hub 9 the long support ribs 27 outwardly push the proximal main ribs 20 open and the distal ends 29 of the long support ribs 27 downwardly slide. Further, since the distal ends 29 of the long support suport ribs 27, slide members 30 and proximal ends of the distal main ribs 22 are connected together, the distal main ribs 22 are outwardly pushed from the upper stops 31 while sliding until the slide members 30 strike the lower stops 32 at point J', causing the long main ribs 18 to extend and outwardly open. When the lower hub 9 is upwardly slid to a position where it is locked by a lock provided in the center pole 1, the canopy is opened in an oval form as shown in FIG. 2.

When the lower hub 9 is downwardly slid from the opened umbrella state, the short main ribs 3 are moved along the center pole by the support ribs 10 as in a conventional umbrella. As for the long main ribs 18, under an action reverse to that of opening the umbrella and as the lower hub 9 lowers, the long support ribs 27 slide along the proximal main ribs 20 while pulling the long main ribs 18 toward the center pole 1 and pulling the distal main ribs 22 into the proximal main ribs 20, causing them to extend along the center pole 1. Ultimately, point G moves to point J at the stop 31.

If the length AD from the proximal ends 4 of the short main ribs 3 to the point of attachment of the support ribs 10, the length DC of the support ribs 10, the distance AB between the upper and intermediate hubs 2 and 23, the length BF of the stay ribs 24, and the length FC from the proximal ends 28 of the long support ribs 27 to the point of attachement of the stay ribs 24 are in the relation $AD+DC=AB+BF+FC$ and if the length AJ from the proximal ends 19 of the proximal main ribs 20 to the stops 31, and the length GF from the distal ends 29 of the long support ribs 27 to the point of attachment of the stay ribs 24 are in the relation $AB+BF=AJ+GF$, then the short main ribs 3 and support ribs 10, the stay ribs 24 and long support ribs 27, and the long main ribs 18 and long support ribs 27 are respectively substantially aligned with each other and extend parallel with the center pole 1. Further, since the length AH of the long main ribs 18 presented when the proximal ends 30 of the distal main ribs 22 strike the stops J is made equal to the length AE of the short main ribs 3, the distal ends of the long and short main ribs 3 and 18 lie on the same plane; thus, the umbrella can be closed with the umbrella ribs neatly folded.

The proportion of the maximum length of the long main ribs 18 to the length of the short main ribs when the umbrella is opened can be easily determined by determining the slide distance J, J' for the proximal main ribs 20.

When the umbrella is closed, the umbrella cloth 33 produces a surplus corresponding to the projected length of the distal main ribs 22. If, however, the umbrella cloth is suitably fastened to the upper stops 31 and to the slide members 30 or the lower stops 32, upon closure of the umbrella the surplus of the umbrella cloth 33 is folded double in the neighborhood of the upper stops 31 and projects outwardly; thus it can be easily treated when the umbrella is closed.

Figure 4:
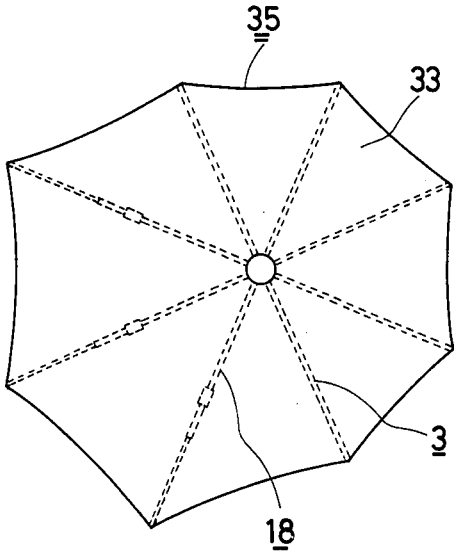
FIGS. 4 and 5 are plan views of another embodiments of the invention when opened.

An embodiment of the invention shown in FIG. 4 will now be described.

A plurality of short main ribs 3 and a plurality of long main ribs 18 (5 short main ribs 3 and 3 long main ribs 18 in FIG. 4) similar in construction to those shown in the first embodiment are arranged around the center pole 1 such that the same type of main ribs are successive (in FIG. 4, 5 short main ribs 3 and 3 long main ribs 18), thus forming umbrella ribs, on which an umbrella cloth 33 serving as a canopy is spread and fixed, thus providing an umbrella 35. The canopy presents a substantially oval form similar to the conventional circular form spreading out to one side.

The functions of the umbrella ribs are the same as in the first embodiment.

Figure 5:
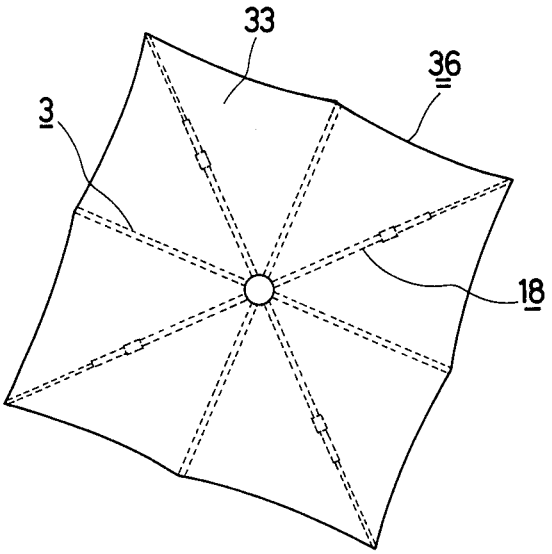

An embodiment of the invention shown in FIG. 5 will now be described.

A plurality of short main ribs 3 and a plurality of long main ribs 18 similar to those used in the first embodiment are alternately arranged around the center pole 1 (in FIG. 5, four each) to form umbrella ribs, on which an umbrella cloth 33 is spread and fixed, thus constituting an umbrella 36. The canopy, unlike those of the first and second embodiments, presents a star form closely resembling a square.

The functions of the umbrella ribs are the same as in the first embodiment.

While preferred embodiments of the invention have been described using specific terms, such description is for illustrative purposes only, and it is to be understood that changes and variations may be made without departing from the spirit and scope of the following claims.

What is claimed is:

1. An umbrella with an oval canopy, comprising:

(A) a center pole having an upper hub fixed thereto, and intermediate and lower hubs slidably mounted thereon;

(B) a plurality of short main ribs which are pivotally connected at their proximal ends to said upper hub and to which are pivotally connected at their middle regions the distal ends of support ribs whose proximal ends are pivotally connected to said lower hub;

(C) and a plurality of long main ribs each consisting of:

(a) a proximal main rib pivotally connected at its proximal end to said upper hub;

(b) a distal main rib slidably fitted to the distal end of said proximal main rib through a slide member, said slide member having pivotally connected thereto the distal end of a long support rib to which is pivotally connected at its middle region the distal end of a stay rib pivotally connected at its proximal end to said intermediate hub and whose proximal end is pivotally connected to said lower hub;

(c) and upper and lower stops fixed on said long main rib.

2. An umbrella as set forth in claim 1 wherein the distal main rib is slidably inserted in said proximal main rib.

3. An umbrella as set forth in claim 1 wherein the proximal main rib is slidably inserted in said distal main rib.

4. An umbrella as set forth in claim 1 or claim 2 wherein the lower stop is a ring.

5. An umbrella as set forth in claim 1 or claim 3 wherein the lower stop is a projection formed by bending the distal end of said proximal main rib.

6. An umbrella as set forth in one of claims 1 to 3 wherein a plurality of said long main ribs and a plurality of said short main ribs are respectively symmetrically arranged with respect to the center pole.

7. An umbrella as set forth in one of claims 1 to 3 wherein a plurality of said long main ribs and a plurality of said short main ribs are arranged around the center pole such that the same type of main ribs are successive.

8. An umbrella as set forth in one of claims 1 to 3 wherein a plurality of said long main ribs and a plurality of said short main ribs are arranged around the center pole such that the dissimilar types of main ribs alternate with each other.

9. An umbrella as set forth in claim 4 wherein a plurality of said long main ribs and a plurality of said short main ribs are respectively symmetrically arranged with respect to the center pole.

10. An umbrella as set forth in claim 4 wherein a plurality of said long main ribs and a plurality of said short main ribs are arranged around the center pole such that the same type of main ribs are successive.

11. An umbrella as set forth in claim 4 wherein a plurality of said long main ribs and a plurality of said short main ribs are arranged around the center pole such that the dissimilar types of main ribs alternate with each other.

12. An umbrella as set forth in claim 5 wherein a plurality of said long main ribs and a plurality of said short main ribs are respectively symmetrically arranged with respect to the center pole.

13. An umbrella as set forth in claim 5 wherein a plurality of said long main ribs and a plurality of said short main ribs are arranged around the center pole such that the same type of main ribs are successive.

14. An umbrella as set forth in claim 5 wherein a plurality of said long main ribs and a plurality of said short main ribs are arranged around the center pole such that the dissimilar types of main ribs alternate with each other.

* * * * *